US006481028B1

(12) United States Patent
Hsia

(10) Patent No.: US 6,481,028 B1
(45) Date of Patent: Nov. 19, 2002

(54) SHOWER AND BATH AND SHOWER STALLS THAT HAVE PUMPS

(76) Inventor: Chih-Yu Hsia, 301 Warren Way, Arcadia, CA (US) 91007

( * ) Notice: Subject to any disclaimer, the term of this patent is extended or adjusted under 35 U.S.C. 154(b) by 0 days.

(21) Appl. No.: 09/886,723

(22) Filed: Jun. 22, 2001

(51) Int. Cl.[7] ..... A47K 3/20
(52) U.S. Cl. ..... 4/570; 4/596; 4/598
(58) Field of Search ..... 4/559, 567, 568, 4/570, 597, 598, 603, 596, 602

(56) References Cited

U.S. PATENT DOCUMENTS 4,153,954 A * 5/1979 Jacuzzi et al. ..... 4/568 X
4,828,709 A * 5/1989 Houser et al. ..... 4/598 X
4,893,364 A * 1/1990 Keeler ..... 4/597
5,206,963 A * 5/1993 Wiens ..... 4/603
5,233,706 A * 8/1993 Maehr ..... 4/598 X
5,293,654 A * 3/1994 Castwall et al. ..... 4/598

* cited by examiner

*Primary Examiner*—Robert M. Fetsuga

(57) ABSTRACT

In apparatus to facilitate taking prolonged showers consisting of a shower stall or a bath and shower stall system which has features of a shower stall or a bath and shower stall, a water supply system, which has a fresh water supply system which can convey and control cold and hot fresh waters to a common water supply system which conveys waters to the shower head of the shower stall or the bath and shower stall system, and, a recycled water supply system, which can store, pump, reheat, control, and recycle the used shower water.

18 Claims, 6 Drawing Sheets

SHOWER AND BATH AND SHOWER STALLS THAT HAVE PUMPS

BACKGROUND OF THE INVENTION

1. Field of the Invention

Taking shower is generally an enjoyable thing. However, taking a prolonged shower takes and wastes a lot of water. Sometimes, taking a prolonged hot shower can exhaust the hot water supply thus results in a cold shower at the end. This current invention provides means to recycle and reheat the water used in the shower to ensure a comfortable prolonged shower. This current invention also provides means to switch from recycled water to fresh water so that a completed and sanitized shower can be made easy. Therefore, this invention relates to shower and bath and shower stalls and particularly to shower and bath and shower stalls that have pumps and heaters to continuously supply recycled hot water for prolonged showers for pleasures and enjoyments. The invented shower stalls and the bath and shower stalls also have means to switch from recycled water to fresh water so that the users can take clean showers.

2. Description of the Prior Arts

No prior art related to shower and bath and shower stalls that have pumps was found.

SUMMARY OF THE INVENTION

Two kinds of the invented devices and their combinations are introduced. Basically, each of them consists of:

a) a shower stall or a bath and shower stall system which has standard features of a shower stall or a bath and shower stall;

b) a water supply system which consists of a fresh water supply system, which can supply and control cold and hot fresh waters to the shower head of the shower stall or the bath and shower stall system, and a recycled water supply system, which can store, pump, reheat, control, and recycle the used shower water.

One object of the current inventions is to provide means to recycle water for a prolonged shower. The other object of the inventions is to provide means to reheat recycled shower water and provide means to control the temperatures of the water. The other object is to provide means to revert from recycled water back to fresh water for a sanitized shower.

These and other objects and advantages of the invention, as well as the details of an illustrative embodiment, will be more fully understood from the following specification and drawings, in which:

DRAWING DESCRIPTION

GENERAL DESCRIPTION

Figure 1:
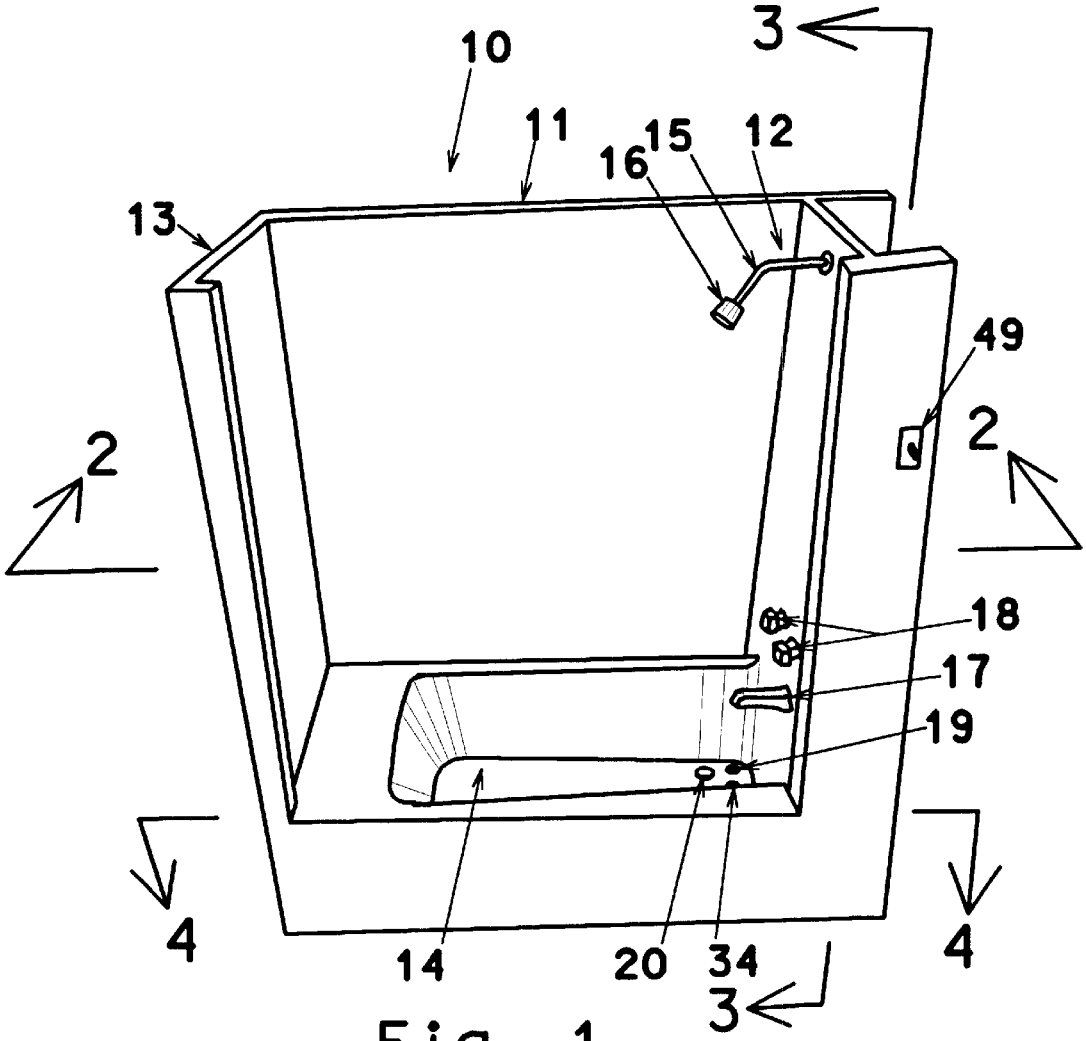
FIG. 1 is an isometric view of a variation of the invented device.
Figure 2:
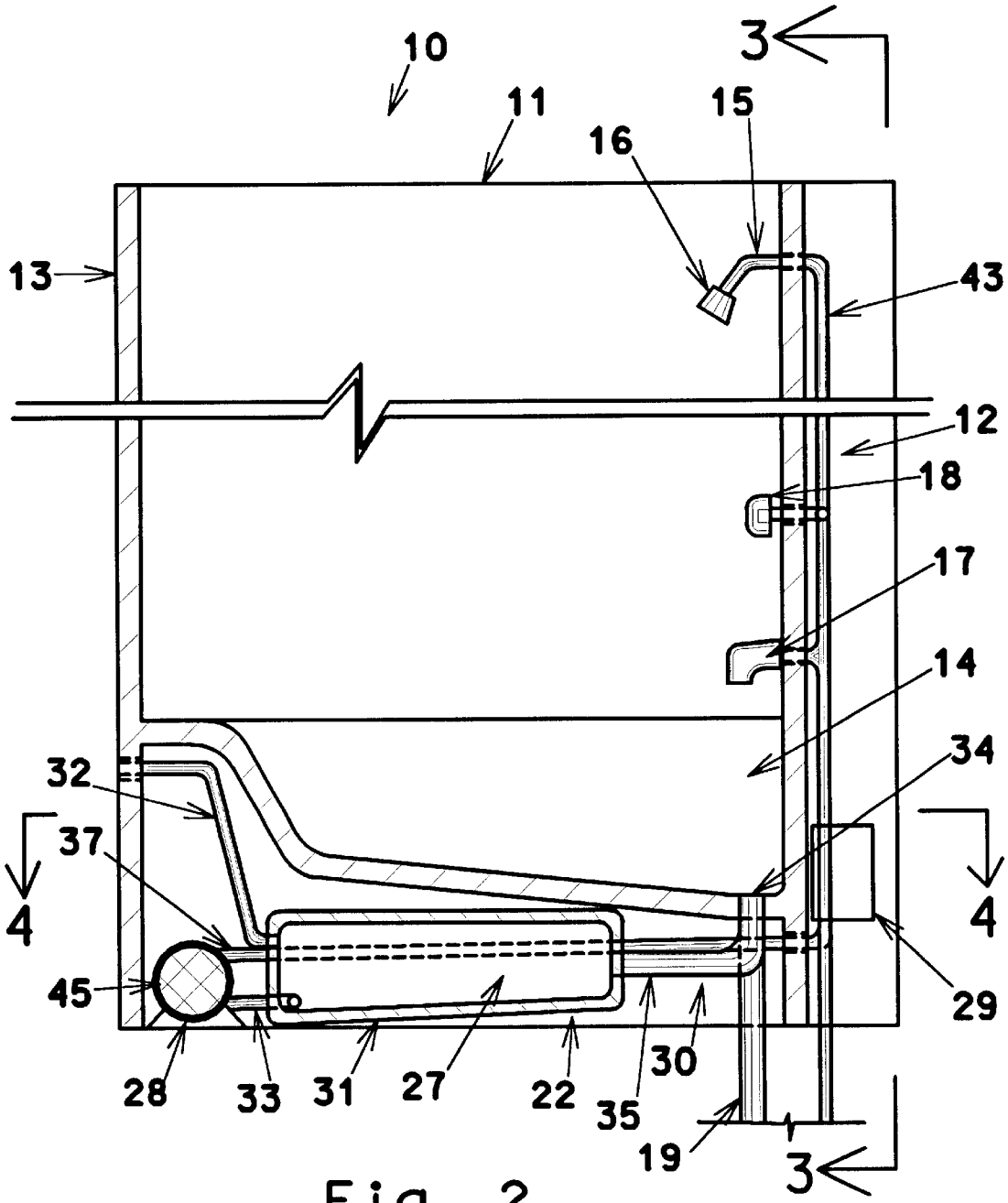
FIGS. 2, 3 and 4 are sectional views of the device shown in FIG. 1.

Two variations of the invented devices are introduced in this specification.

Referring to FIGS. 1 through 4, the invented bath and shower stall that has a pump 10 consists of a bath and shower stall system 11 and a water supply system 12.

The bath and shower stall system consists of a shower stall 13 and a bathtub 14 which have features such as a shower arm 15, a shower head 16, a shower curtain (not shown) or sliding doors (not shown), a spout 17, faucets 18, a overflow plate (not shown), a tub drain 19, and a tub drain plug 20, etc. of a bath and shower stall.

The water supply system consists of a fresh water supply system 21, a common water supply system 43, and a recycled water supply system 22. The fresh water supply system consists of a cold fresh water piping 23, a hot fresh water piping 24, a valve 25, and a mixed fresh water piping 26. The cold fresh water piping and the hot fresh water piping are pipes that can convey cold and hot fresh waters, respectively. The valve is a faucet (as shown) or two faucets (not shown) which can control the hot and the cold fresh waters and allow them to mix. The mixed fresh water piping is a pipe that can convey the mixed water.

The recycled water supply system consists of a water storage system 27, a pumping system 28, and a water heater 29. The water storage system consists of an inlet plumbing system 30, a water storage tank 31, a vent pipe 32, and an outlet plumbing system 33. The inlet plumbing system consists of a drain 34 which is drain at the bottom of the bathtub and a pipe 35 which one end connects with the drain and the other end connects with the water storage tank. The water storage tank is a tank that also connects with the vent pipe and the outlet plumbing system. The outlet plumbing system is a piping system which one end connects with the water storage tank and the other end connects with the pump 36 of the pumping system. The vent pipe is a pipe which provides vent to the water storage tank.

The water heater is a water pressure or flow activated gas or electrical water heater. The pumping system consists of a motor 45, a pump 36, a pump discharge pipe 37, a water heater inlet pipe 38, a water heater outlet pipe 39, a water heater bypass pipe 40, a valve 41, and a mixed recycled water piping 42. The pump, the pump discharge pipe, the water heater bypass pipe, the water heater inlet pipe, the water heater, and the water heater outlet pipe can convey recycled water to the valve 41 which is a faucet (as shown) or two faucets (not shown) which can control the hot recycled water from the water heater and the cold recycled water from the water heater bypass pipe and allow them to mix. The pump discharge pipe, the water heater bypass pipe, the water heater inlet pipe, the water heater outlet pipe and the valve form the pump discharging plumbing system. The mixed recycled water piping is a pipe that can convey the mixed water. The pumping system also has a motor control and power supply system (not shown) which includes switches, wires, and timer(s), etc. The motor control and power supply system controls the supply of power to the motor which turns the pump. The motor control and power supply system has a pressure and timer switch which is a switch triggered by excessive water pressure and activated after a preset timing. This pressure and timer switch will automatically shut off power to the motor if the pump pumps against a preset high hydraulic pressure for a predetermined period of time. The motor control and power supply system has a water level switch in the water storage tank. When the water level in the water storage tank is too low this water level switch will shut off the motor for the pump. The motor control and power supply system has a power on toggle switch 49 which can switch on and off of the pump.

Figure 3:
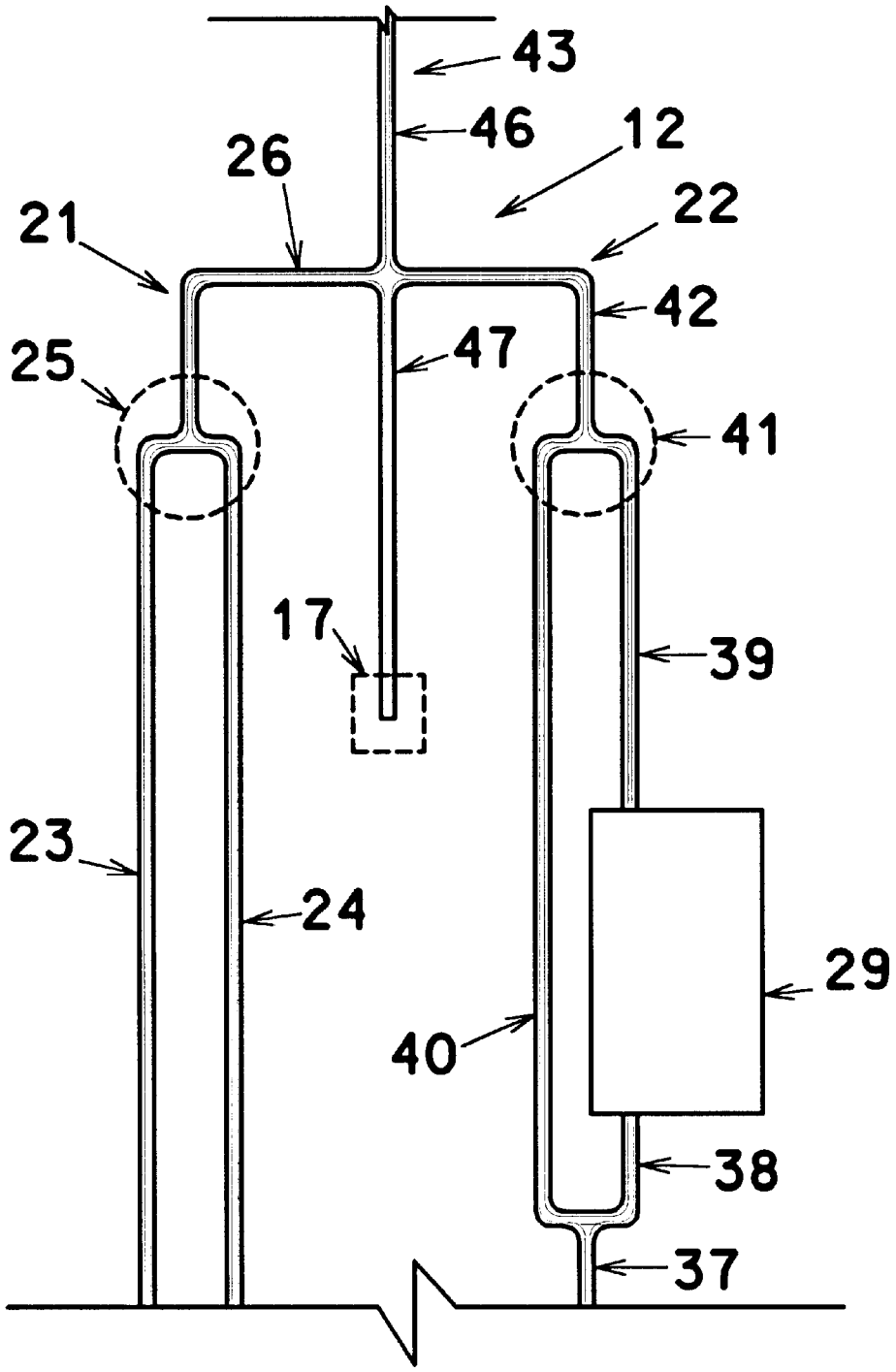
Figure 4:
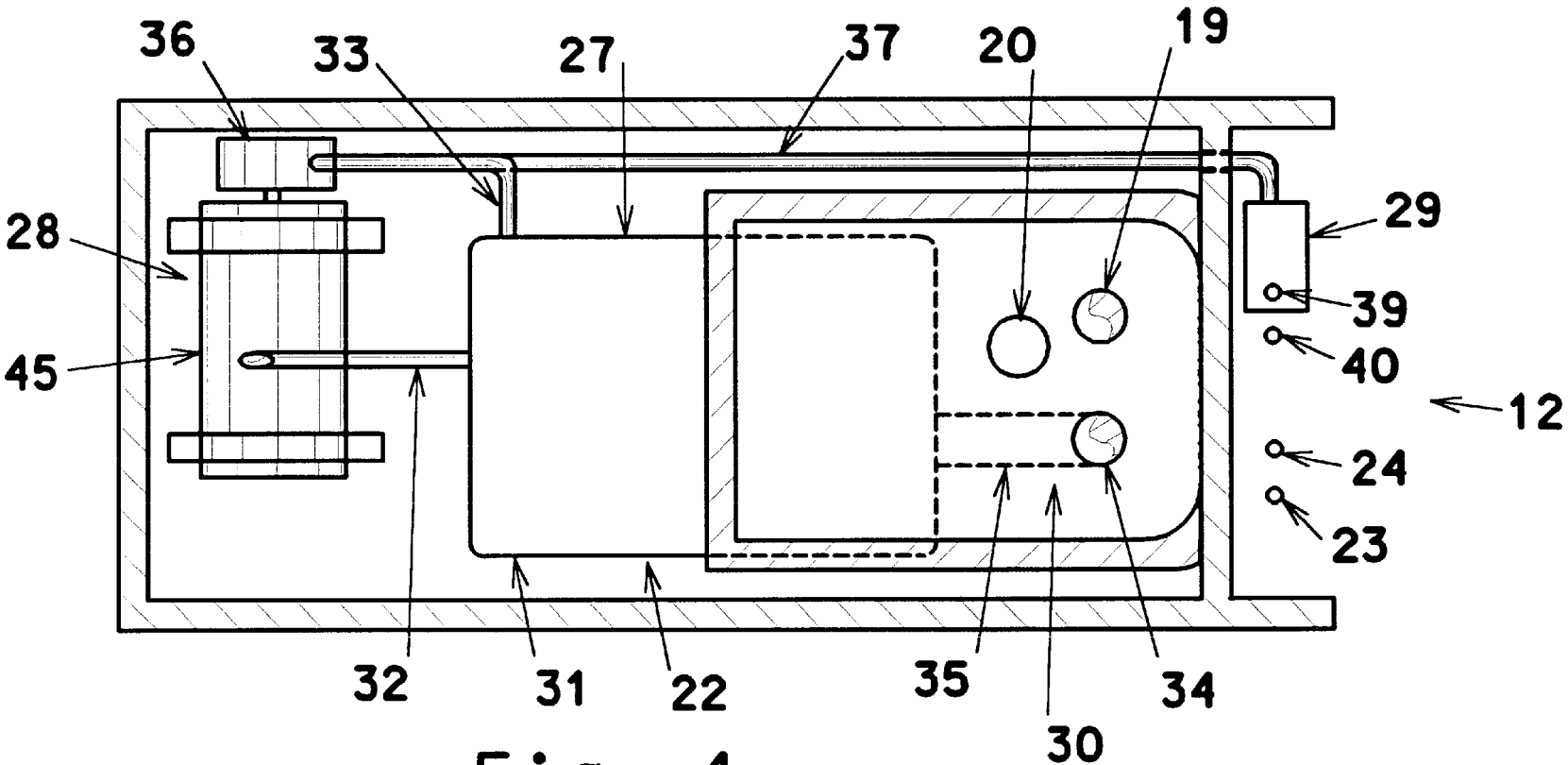
Figure 6:
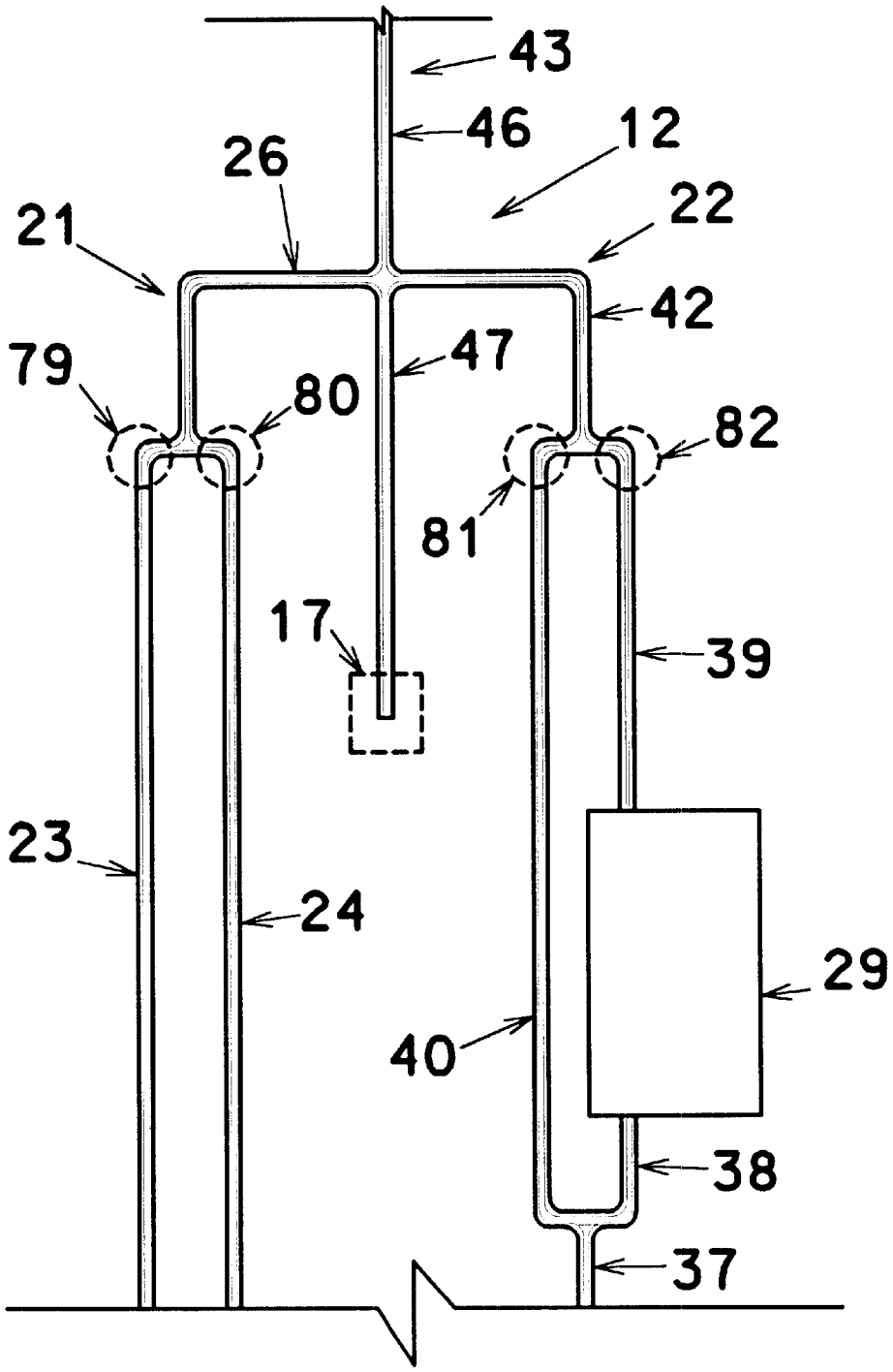
FIG. 6 is a sectional view of a device similar to the one shown in FIG. 1.

Referring to FIG. 3 and FIG. 6, in lieu of using a single valve 25 to control the hot and the cold fresh waters as shown in FIG. 3, two valves 79 and 80, FIG. 6, can be used to control the cold fresh water and the hot fresh water, respectively. Similarly, two valves 81 and 82, FIG. 6, can be used to control the cold recycled water and the hot recycled water, respectively, instead of using one single valve 41 as shown in FIG. 3.

Referring to FIG. 7, a level switch is a switch which has pre-set water level information, 71. The switch can constantly monitor, 72, the water level in the water storage tank. When the water level in the water storage tank is higher than the pre-set water level information, the motor will continue running, 74. When the water level in the water storage tank is equal to or lower than the pre-set water level information, the motor will be shut off, 73, and the pump will stop.

Referring to FIG. 3 and FIG. 8, in lieu of using a single valve 25 to control the hot and the cold fresh waters as shown in FIG. 3, two valves 79 and 80, FIG. 8, can be used to control the cold fresh water and the hot fresh water, respectively. Similarly, two valves 81 and 82, FIG. 8, can be used to control the cold recycled water and the hot recycled water, respectively, instead of using one single valve 41 as shown in FIG. 3.

The common water supply system consists of up pipe 46 and a down pipe 47. The up pipe is a pipe which one end connects with the shower arm and which the other end connects with the mixed recycled water piping and the mixed fresh water piping. The down pipe is also a pipe which one end connects with the spout and which the other end connects with the mixed recycled water piping and the mixed fresh water piping.

Figure 5:
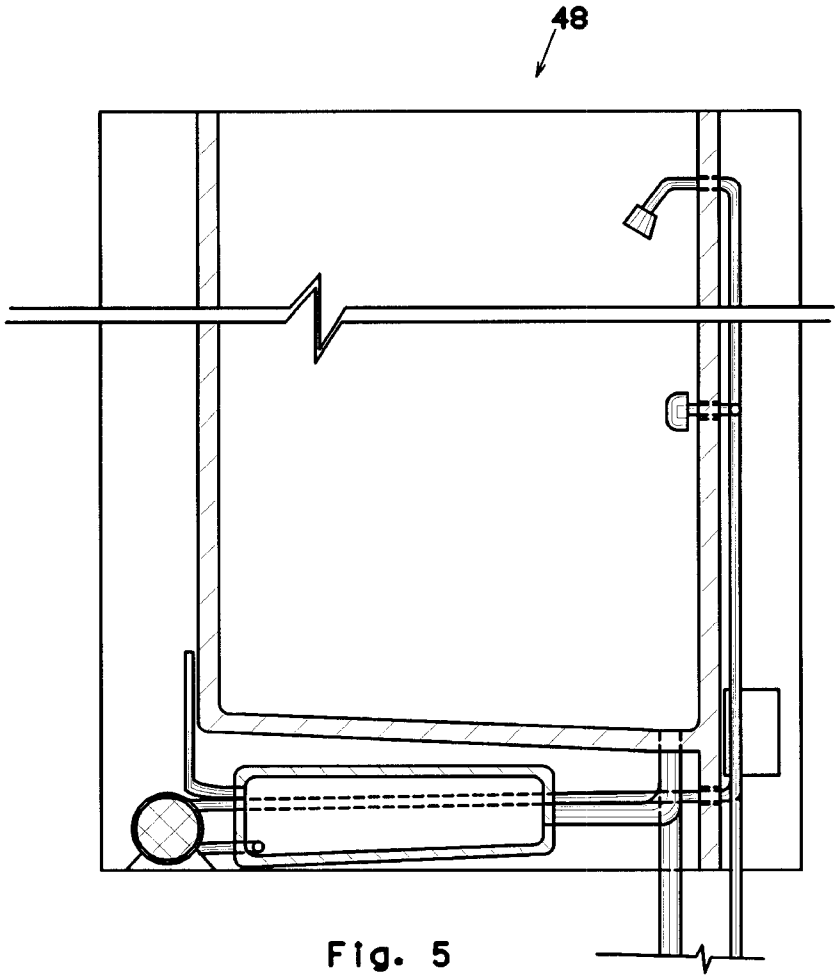
FIG. 5 is a sectional view of a variation of the invented device.

Referring to FIG. 5, the invented shower stall that has a pump 48 is very similar to the invented bath and shower stall that has a pump described above. The major differences between these two variations of the invented devices are that the invented shower stall that has a pump does not have the bathtub, the spout and its associated down pipe.

Referring to FIG. 1, in using the invented bath and shower stall that has a pump, the user plugs the tub sink 19 first with the tub drain plug 20. Then, the user turns on the faucets to let fresh water into the bathtub. Water enters the bathtub will drain through the drain 34 and the pipe 35 (referring to FIGS. 1, 2 and 4) then enters into the water storage tank 31. When the water storage tank is about full or water can not be drained from the bathtub any more, the user turns off the fresh water. The user then turns on the power on toggle switch 49 (FIG. 1) which turns the motor and the pump on. The user then turns on the faucet(s) of the recycled water supply system. Water will then come out from either the spout or the shower head. The discharged water can drain back into the drain 34 then into the water storage tank. The water then can be recycled by the pump and pumped through the shower head or the spout. The start of flowing of the recycled water through the water heater will turn on the water heater.

When the user selects to let water be discharged through the shower head, the user can take a shower as long as desired without wasting fresh water. The user can operate the faucet(s) of the recycled water supply system to control the ratio of recycled water between passing through the water heater and the water heater bypass pipe so that the temperature of the recycled water discharged from the shower head can be selected and controlled.

After having the pleasure of a long shower, the user can turn off the faucet(s) of the recycled water supply system. The stop of the recycled water will turn off the water heater. The stop of the recycled water will cause the pump to pump against high hydraulic pressure and after a while will activate the pressure and timer switch to shut off the pump. The user can unplug the tub sink 19 and plug the drain 34 by moving the tub drain plug 20 from the tub sink 19 to the drain 34. The user then can take a regular fresh water shower to complete his/her shower.

In lieu of turning off the faucet(s) of the recycled water supply system to stop the recycled water, the user may unplug the tub sink 19 and plug the drain 34 first to stop the recycled water. To plug the drain will cause the recycled water not being able to enter the water storage tank. When the pump continuously sucks out the water in the water storage tank, the water level in the water storage tank will continuously drop. Eventually, when the water level is low enough the water level switch in the water storage system will shut off the pump. The unplugged tub sink will drain the recycled water discharged from the shower head or the faucet. Thus, the recycled water system can be drained if needed.

Although the foregoing descriptions of the uses of the invented devices concentrate on the invented bath and shower stalls that have pumps, the uses of the invented shower stalls that have pumps are very similar to those described. Therefore, the uses of the invented shower stall that has a pump are not described herein.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, failing within the scope of the invention as claimed.

I claim:

1. A bath and shower stall that has a pump comprising, in combinations:

a) a bath and shower stall system which has standard features such as a shower arm, a shower head, a shower curtain, a bathtub, a spout, faucets, a overflow plate, a tub drain, etc. of a bath and shower stall;

b) a water supply system which consists of a fresh water supply system, a recycled water supply system and a common water supply system;

c) said common water supply system being a plumbing system which can convey waters to said shower head;

d) said fresh water supply system being a plumbing system which can convey and control cold and hot fresh waters to said common water supply system;

e) said recycled water supply system consisting of a water storage system, a pumping system, and a water heater;

f) said water storage system consisting of an inlet plumbing system, a water storage tank, and an outlet plumbing system;

g) said inlet plumbing system conveying water drained from said bathtub to said water storage tank which connects with said outlet plumbing system;

h) said outlet plumbing system connecting with said pumping system which consists of a motor, a pump, a motor control and power supply system, and a pump discharging plumbing system which can convey and control a portion of the water discharged from said pump via said water heater of said recycled water supply system to said common water supply system;

i) said pump discharging plumbing system of said pumping system also being able to convey and control a portion of the water discharged from said pump to said common water supply system.

2. The bath and shower stall that has a pump of claim 1 wherein said water storage tank has a vent.

3. The bath and shower stall that has a pump of claim 1 wherein said pump discharging system has a valve.

4. The bath and shower stall that has a pump of claim 1 wherein said pump discharging plumbing system has a valve in plural form.

5. The bath and shower stall that has a pump of claim 1 wherein said fresh water supply system has a valve.

6. The bath and shower stall that has a pump of claim 1 wherein said fresh water supply system has a valve in plural form.

7. The bath and shower stall that has a pump of claim 1 wherein said inlet plumbing system of said water storage system has a plug.

8. The bath and shower stall that has a pump of claim 1 wherein said tub drain of said bath and shower stall system has a plug.

9. The bath and shower stall that has a pump of claim 1 wherein said motor control and power supply system has a power on/off toggle switch.

10. A shower stall that has a pump comprising, in combinations:

a) a shower stall system which has standard features such as a shower arm, a shower head, a shower curtain, faucets, a drain, etc. of a shower stall;

b) a water supply system which consists of a fresh water supply system, a recycled water supply system and a common water supply system;

c) said common water supply system being a plumbing system which can convey waters to said shower head;

d) said fresh water supply system being a plumbing system which can convey and control cold and hot fresh waters to said common water supply system;

e) said recycled water supply system consisting of a water storage system, a pumping system, and a water heater;

f) said water storage system consisting of an inlet plumbing system, a water storage tank, and an outlet plumbing system;

g) said inlet plumbing system conveying water drained from said shower stall system to said water storage tank which connects with said outlet plumbing system;

h) said outlet plumbing system connecting with said pumping system which consists of a motor, a pump, a motor control and power supply system, and a pump discharging plumbing system which can convey and control a portion of the water discharged from said pump via said water heater of said recycled water supply system to said common water supply system;

i) said pump discharging plumbing system of said pumping system also being able to convey and control a portion of the water discharged from said pump to said common water supply system.

11. The shower stall that has a pump of claim 10 wherein said water storage tank has a vent.

12. The shower stall that has a pump of claim 10 wherein said pump discharging system has a valve.

13. The shower stall that has a pump of claim 10 wherein said pump discharging plumbing system has a valve in plural form.

14. The shower stall that has a pump of claim 10 wherein said fresh water supply system has a valve.

15. The shower stall that has a pump of claim 10 wherein said fresh water supply system has a valve in plural form.

16. The shower stall that has a pump of claim 10 wherein said inlet plumbing system of said water storage system has a plug.

17. The shower stall that has a pump of claim 10 wherein said drain of said shower stall system has a plug.

18. The shower stall that has a pump of claim 10 wherein said motor control and power supply system has a power on/off toggle switch.

* * * * *